US007089755B2

(12) United States Patent
Schmid et al.

(10) Patent No.: US 7,089,755 B2
(45) Date of Patent: Aug. 15, 2006

(54) AIR DUCT SYSTEM FOR A REFRIGERATOR

(75) Inventors: Alexandre Cury Schmid, Joinville (BR); Rogerio Rodrigues Junior, Joinville (BR); Adriano Cargnin, Joinville (BR)

(73) Assignee: Multibras S.A. Eletrodomesticos, Sao Paulo-SP (BR)

( * ) Notice: Subject to any disclaimer, the term of this patent is extended or adjusted under 35 U.S.C. 154(b) by 100 days.

(21) Appl. No.: 10/500,744

(22) PCT Filed: Jan. 28, 2003

(86) PCT No.: PCT/BR03/00010

§ 371 (c)(1),
(2), (4) Date: Sep. 8, 2004

(87) PCT Pub. No.: WO03/064944

PCT Pub. Date: Aug. 7, 2003

(65) Prior Publication Data

US 2005/0056045 A1 Mar. 17, 2005

(30) Foreign Application Priority Data

Jan. 28, 2002 (BR) ..... 0200230

(51) Int. Cl.
*F25D 17/04* (2006.01)

(52) U.S. Cl. ..... 62/407; 62/186; 62/417

(58) Field of Classification Search ..... 62/407, 62/408, 409, 413, 414, 415, 186, 187, 417
See application file for complete search history.

(56) References Cited

U.S. PATENT DOCUMENTS 5,664,437 A * 9/1997 Park et al. ..... 62/407
5,709,101 A 1/1998 Jeong
5,735,138 A * 4/1998 Park et al. ..... 62/455
5,822,998 A * 10/1998 Lim et al. ..... 62/186

FOREIGN PATENT DOCUMENTS

AU 521 756 B1 4/1982

OTHER PUBLICATIONS

Patent Abstracts of Japan; vol. 017, No. 080, Feb. 17, 1993, & JP 04 281173 (Sharp Corp.), Oct. 6, 1992.

* cited by examiner

*Primary Examiner*—Melvin Jones
(74) *Attorney, Agent, or Firm*—Darby & Darby

(57) ABSTRACT

An air duct system for a combined refrigerator of the forced air circulation type and comprising a freezing compartment (1) and a refrigerating compartment (2), which are superposed and separated by an intermediate wall (3), and further having an air cooling compartment (4) lodging an evaporator (5) and a fan (6) and presenting at least one circulated air inlet (4*a*) and at least one refrigerated air outlet (4*b*). The system comprises a body (10) mounted to the inside of the intermediate wall (3) and defining a rear chamber (11), which is opened to the circulated air inlet (4*a*); a transversal through-duct (12) communicating the refrigerated air outlet (4*b*) with the refrigerating compartment (2); at least one first and one second return duct (13, 14) presenting a rear end (13*b*, 14*b*) opened to the rear chamber (11), and a front end (13*a*, 14*a*) opened to the inside of the freezing compartment (1) and of the refrigerating compartment (2), respectively.

13 Claims, 5 Drawing Sheets

AIR DUCT SYSTEM FOR A REFRIGERATOR

FIELD OF THE INVENTION

The present invention refers to a duct system for the distribution of air in combined refrigerators having forced air circulation and presenting a single cabinet defining a freezing compartment and a refrigerating compartment that are separated by an intermediate wall.

BACKGROUND OF THE INVENTION

The combined refrigerators with forced air circulation are provided with ducts for the conduction of cold air coming from the evaporator, to both the freezing and the refrigerating compartments.

In a prior art construction, the ducts, which promote the fluid communication of the freezing and refrigerating compartments with the evaporator, are constructed in EPS molded pieces, normally three pieces, comprising a base, a cover, and a complement, defining a hollow block, which is mounted to the inside of the intermediate wall of the freezing and refrigerating compartments, before the cabinet walls are filled with a thermal insulation material.

In another construction pertaining to the state of art, the air ducts, which promote the fluid communication of the freezing and refrigerating compartments, are formed in plastic pieces, which are normally blow molded, and whose ends are connected to specific points of the compartments. These pieces are externally covered with the thermal insulation material, which is subsequently injected to the inside of the cabinet walls.

In both prior art constructions considered above, the captation of cold air from the evaporator, to be supplied into the refrigerating compartment, is laterally made through an air distribution plenum provided in the rear region of the freezing compartment, since the fan that impels the airflow is centrally positioned in the cabinet. The need of providing the captation of cold air to the refrigerating compartment in an offset position in relation to the central plane of the cabinet is due to the presence of an air return duct that is centrally provided through the intermediate wall, from the front upper region of the refrigerating compartment to the lower region of the evaporator. Thus, for providing the downward directioning of the refrigerated airflow from the evaporator to the rear upper region of the refrigerating compartment, it is necessary to provide a "curved" path, laterally surrounding the air return duct of the refrigerating compartment, in order to have an outlet end inferiorly positioned in relation to said return duct and in communication with a descending central rear duct for supplying refrigerated air to the refrigerating compartment.

There is also the prior art solution designed to be applied to a basic combined refrigerator, of lower cost and in which the distribution of forced airflow is made through a central rear tower in the freezing compartment, and having the return of air by the lower part of the evaporator in the freezing compartment itself and in the rear upper region of the refrigerating compartment. In this type of construction, the captation of air from the refrigerating compartment to the evaporator is effected directly below the evaporator, no interference occurring between the refrigerated air duct coming down from the evaporator to the refrigerating compartment and the air return duct that is centrally mounted in the interior of the intermediate wall. However, this solution presents some disadvantages related to the construction and to the layout of the ducts inside both compartments, as well as to efficiency losses in terms of air circulation.

OBJECTS OF THE INVENTION

As a function of the problems mentioned above, it is an object of the present invention to provide an air duct system for a combined refrigerator of the above mentioned type, presenting a construction of easy manufacture and assembly and defined by a reduced number of component parts, reducing costs in these constructive and operational characteristics of the combined refrigerators with forced air circulation.

A further object of the present invention is to provide an air duct system of the type defined above, which can be easily adapted to refrigerators of the type presenting a tower-type air distribution in the freezing compartment, with the return of air being effected under the evaporator, or being of the high end type, in which the freezing compartment is provided with a plenum and the intermediate wall carries the air return duct from the refrigerating compartment.

SUMMARY OF THE INVENTION

The air duct system of the present invention is applied to a combined refrigerator, such as defined above, further comprising an air cooling compartment, lodging an evaporator and a fan, and having at least one circulated air inlet to receive the air coming from the freezing and refrigerating compartments, and at least one refrigerated air outlet directed to said freezing and refrigerating compartments.

According to the invention, the air duct system comprises a body mounted to the inside of the intermediate wall and defining a rear chamber, which is opened to the circulated air inlet of the air cooling compartment; a transversal through-duct, which is centrally provided in front of the rear chamber, in order to establish a fluid communication between the refrigerated air outlet of the air cooling compartment and the refrigerating compartment; at least one first and one second return duct, each presenting a rear end opened to the rear chamber and a front end opened to the inside of the freezing compartment and of the refrigerating compartment, respectively, the rear ends of the first and the second return ducts being positioned on opposite sides of the transversal through-duct.

The constructive arrangement defined above allows, not only a considerable constructive simplification of the air duct system with forced air circulation to be obtained, making it adaptable to different projects, but also the maintenance of a certain physical separation between the airflows coming from both compartments at different temperatures and which are forced to pass through distinct regions of the evaporator, in order to obtain a higher efficiency from the evaporator.

BRIEF DESCRIPTION OF THE DRAWINGS

The invention will be described below, with reference to the enclosed drawings, in which.

DESCRIPTION OF THE ILLUSTRATED EMBODIMENT

Figure 1:
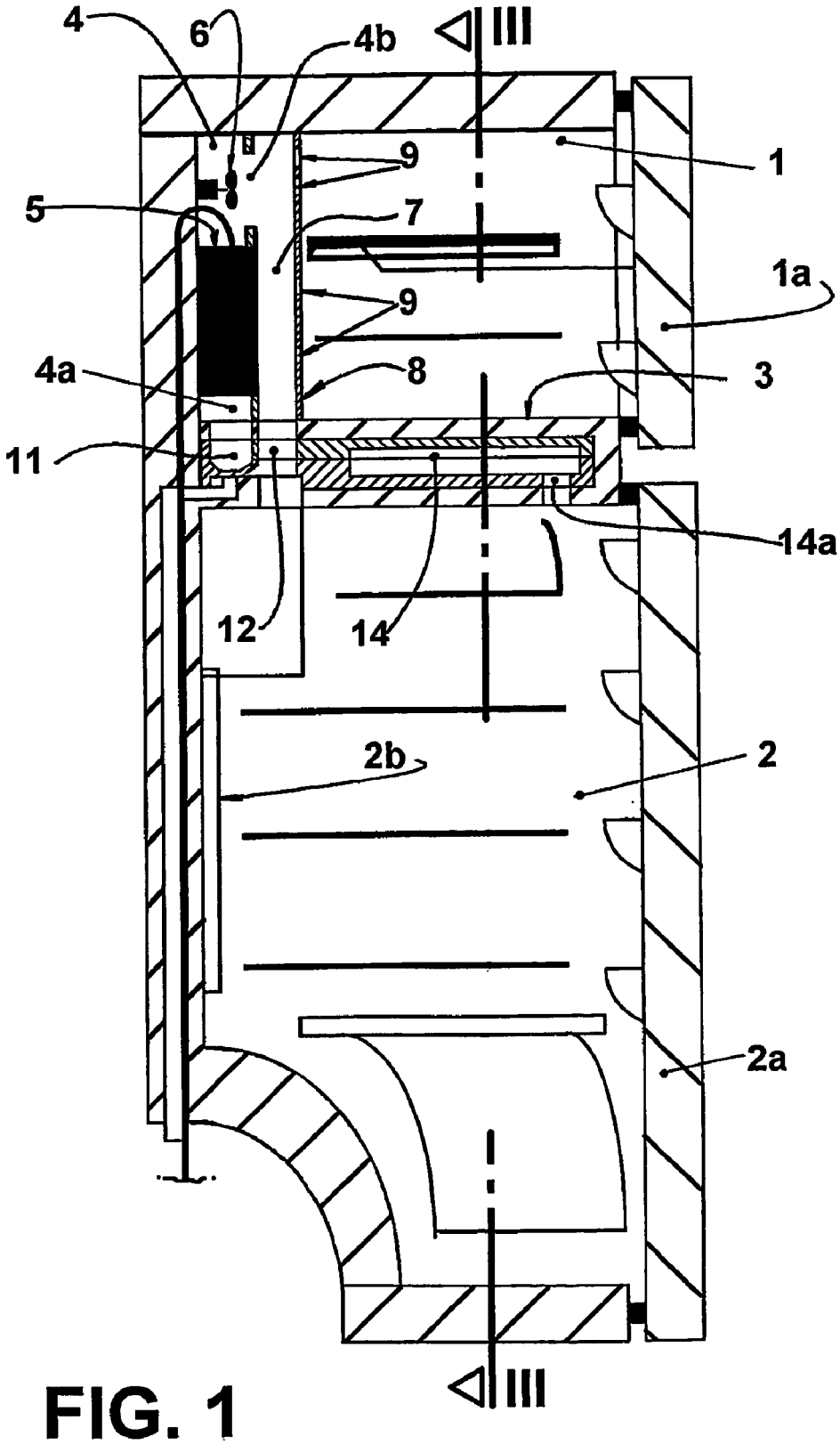
FIG. 1 is a schematic vertical cross-sectional view of a possible construction of a combined refrigerator with forced air circulation, utilized in the present invention, said view being taken to illustrate the return of air from the refrigerating compartment toward the circulated air inlet of the air cooling compartment.
Figure 2:
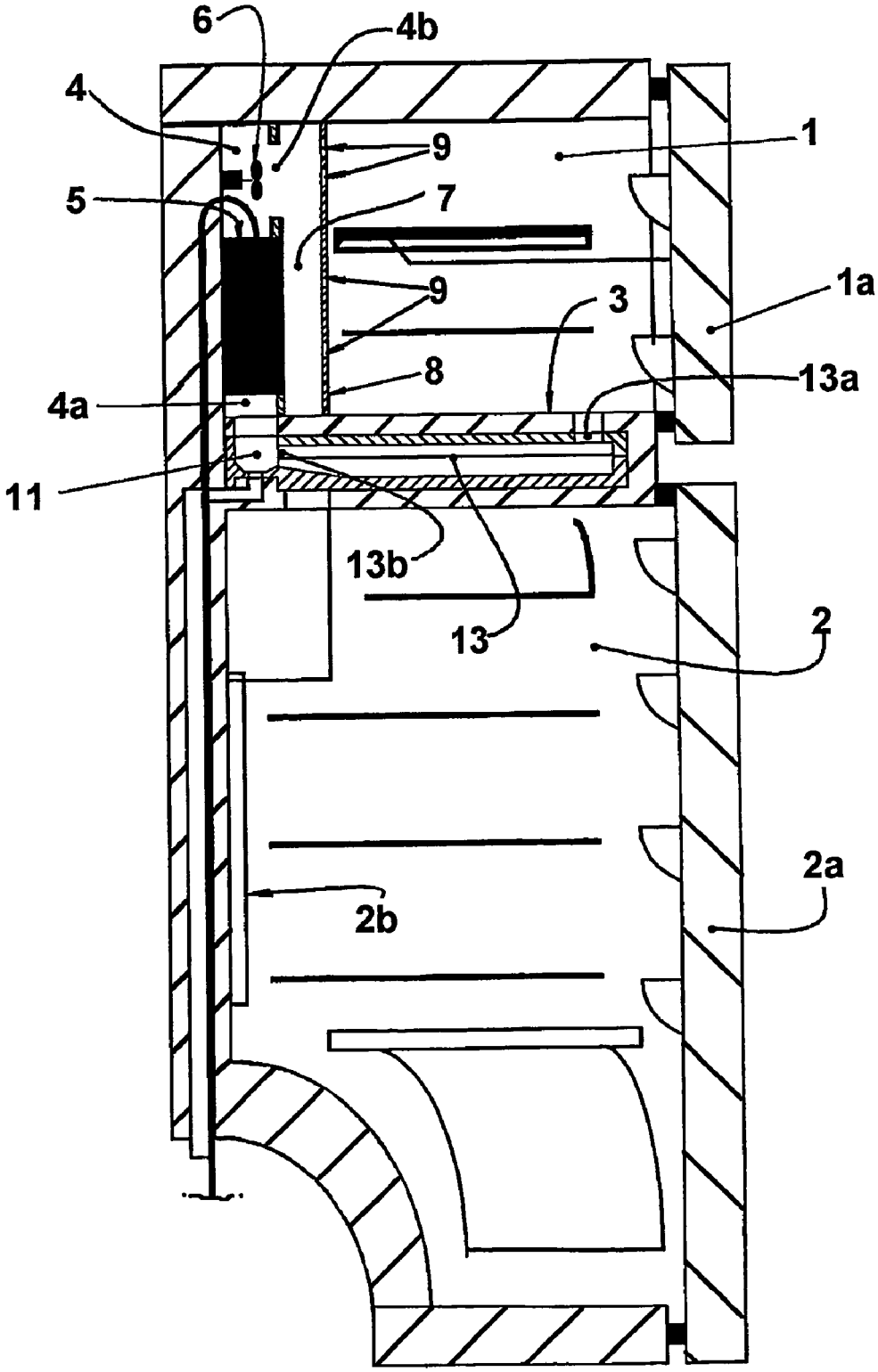
FIG. 2 is a similar view to that of FIG. 1, but taken in order to illustrate the return of air from the freezing compartment toward the circulated air inlet of the air cooling compartment.
Figure 3:
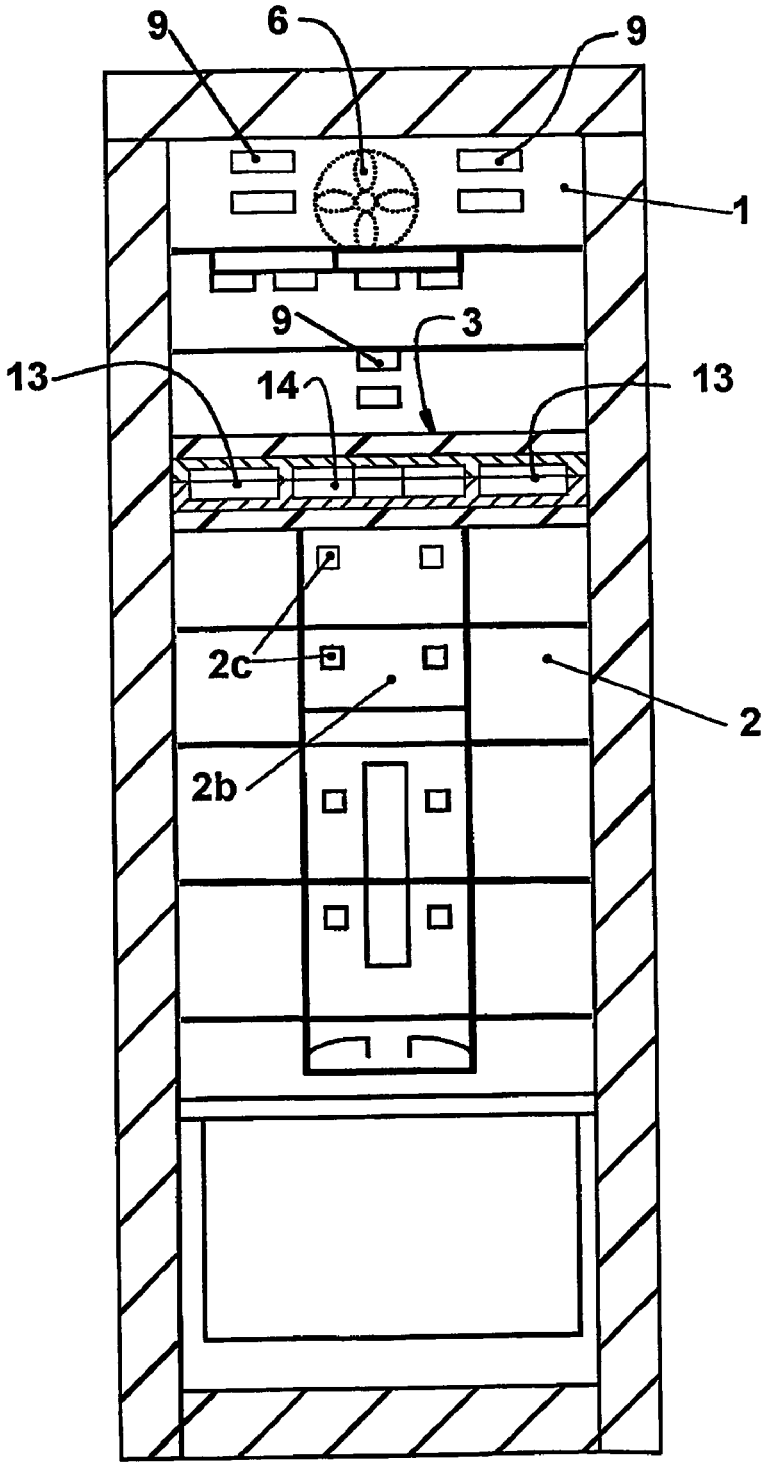
FIG. 3 is a sectional view of the refrigerator of FIGS. 1 and 2, taken according to line III of FIG. 1, for a better visualization of the points in which the refrigerated forced airflow is supplied to the interior of the freezing and refrigerating compartments.
Figure 4:
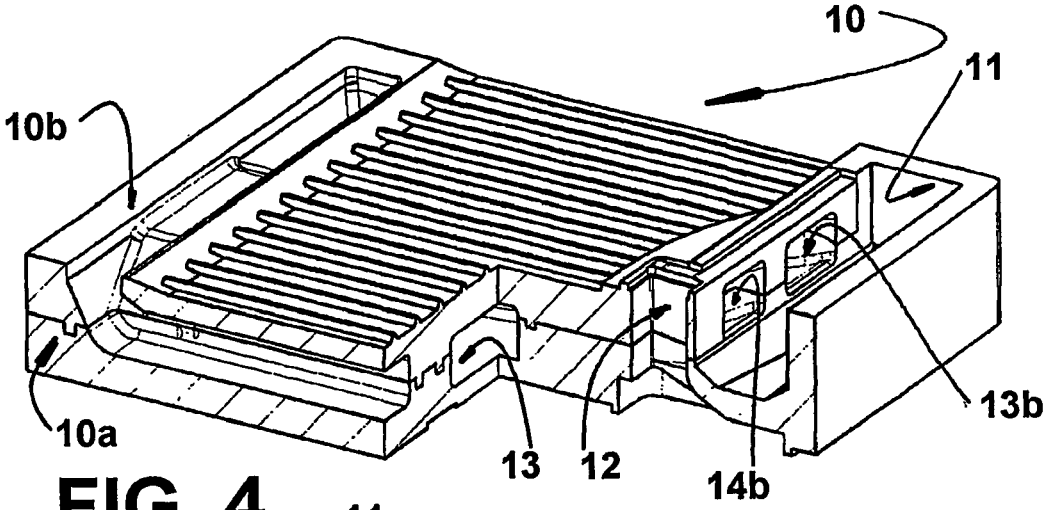
FIG. 4 is a partially cut top perspective view of the body to be inserted into the interior of the intermediate wall.
Figure 5:
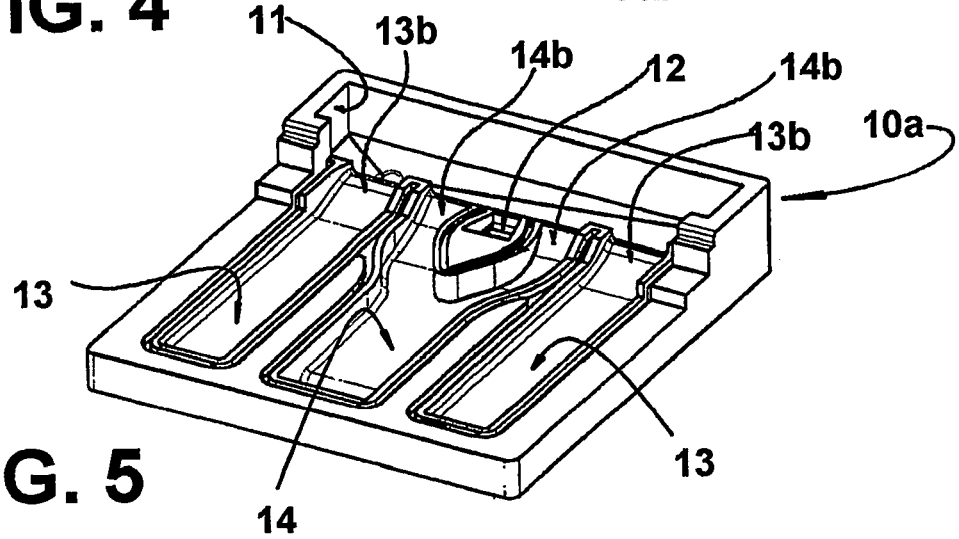
FIG. 5 is a top perspective view of a lower half of the body illustrated in FIG. 3.
Figure 6:
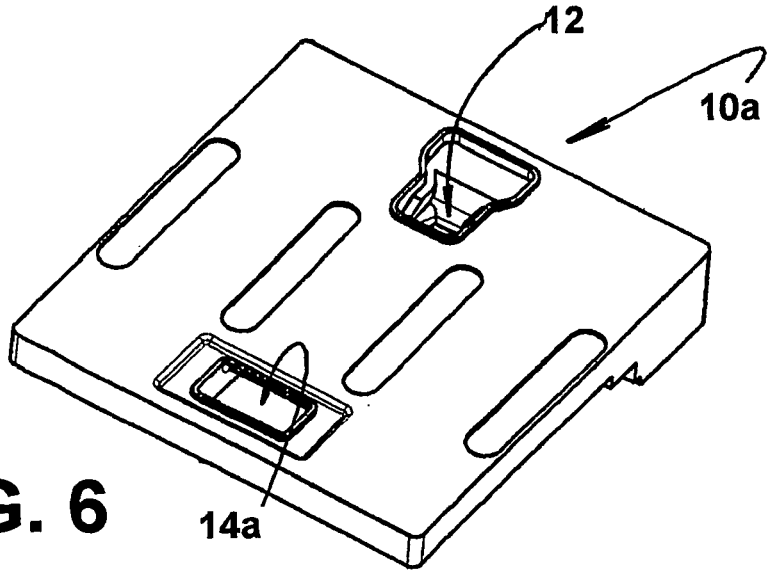
FIG. 6 is a bottom perspective view of the lower half of the body illustrated in FIG. 4.
Figure 7:
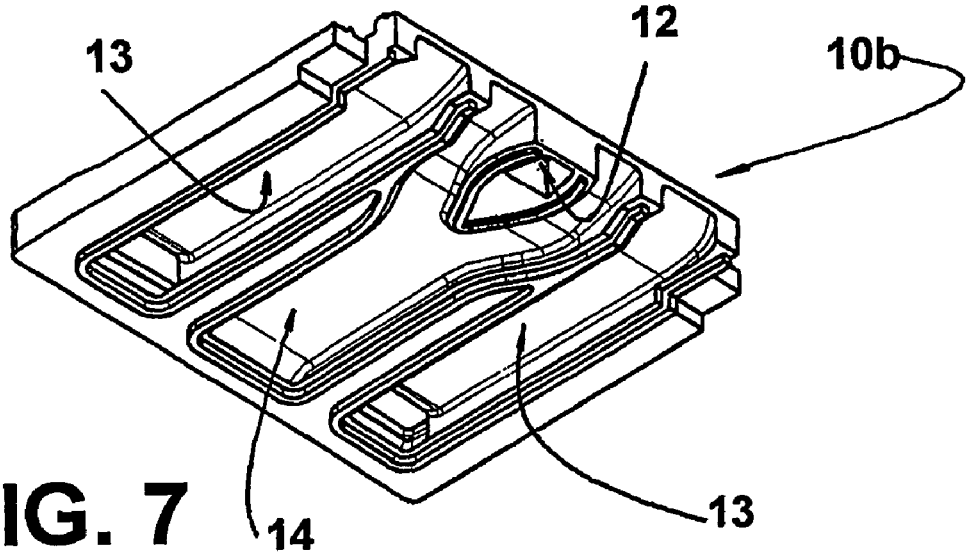
FIG. 7 is a bottom perspective view of an upper half of the body illustrated in FIG. 3.
Figure 8:
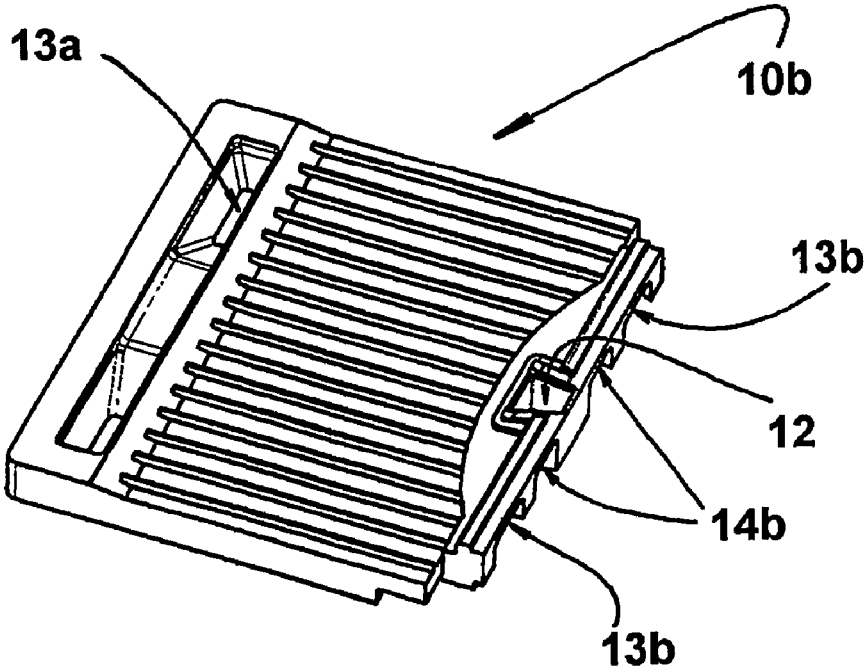
FIG. 8 is a top perspective view of the upper half of the body illustrated in FIG. 6.

As illustrated in FIGS. 1 and 2 and as previously mentioned, the invention is applicable to a combined refrigerator with forced air circulation, comprising a freezing compartment 1 and a refrigerating compartment 2, which are superposed and provided with respective front doors 1*a* and 2*a*, and which are separated by an intermediate wall 3. The combined refrigerator further comprises an air cooling compartment 4 located generally close to the rear region of the freezing compartment 1 and lodging an evaporator 5 and a fan 6. The air cooling compartment 4 presents a circulated air inlet 4*a* and a refrigerated air outlet 4*b* disposed downstream the fan 6. The circulated air outlet 4*b* has a width that is preferably substantially equal to the width of the evaporator 5 by the reasons that will become evident from the description below.

In the preferred embodiment illustrated herein, the air cooling compartment 4 is provided with a circulated air inlet 4*a* defined in the lower region thereof and presents a cross section similar or even equal to that of said air cooling compartment 4. Nevertheless, it should be understood that the circulated air inlet 4*a* could be defined by multiple inlets, shaped in different manners, and which can be individually or jointly associated with respective evaporator sections separated from each other.

The lower positioning of the circulated air inlet 4*a* is due to the fact that the illustrated refrigerator presents the freezing compartment 1 disposed over the refrigerating compartment 2. In the combined refrigerator constructions, in which the freezing compartment 1 is disposed under the refrigerating compartment 2, the circulated air inlet 4*a* is superior, while the refrigerated air outlet 4*b* is inferior in relation to the air cooling compartment 4. In the illustrated arrangement, the refrigerated air outlet 4*b* is opened to the interior of a plenum 7 generally occupying the whole width and height of the freezing compartment 1 and separated therefrom by a generally vertical thin wall 8 provided with openings 9, which are dimensioned and positioned to allow the air refrigerated in the evaporator 5 to be supplied to the freezing compartment.

The refrigerated forced airflow is supplied to the refrigerating compartment 2 from the plenum 7 through the system proposed by the present invention, which further provides the return of air from the freezing compartment 1 and from the refrigerating compartment 2 to the circulated air inlet 4*a* of the air cooling compartment 4.

The duct system of the invention comprises a body 10, generally in the form of a parallelepipedic box of low height, constructed in EPS or other adequate material of low thermal conductivity and easy to mold, which is mounted to the inside of the intermediate wall 3 before filling the structure of the refrigerator cabinet with a thermal insulation material, which is generally defined by polyurethane foam.

In the preferred illustrated construction, the body 10 has a lower half 10*a* and an upper half 10*b*, which are fitted into each other, in order to define internal ducts to be described below.

The body 10 defines a rear chamber 11, which in the illustrated embodiment takes the form of a chute extending along the width of the body 10, having one of its lateral walls incorporated to the lower half 10*a* of the body 10 and being superiorly opened, so as to be adapted to the circulated air inlet 4*a* of the air cooling compartment 4. In the illustrated construction, the contour of the upper edge of the rear chamber 11 coincides with the contour of said circulated air inlet 4*a*, at least regarding the extension of said parts in the direction of the width of the refrigerator. Thus, upon mounting the body 10 to the inside of the intermediate wall 3 and upon completion of the construction of the refrigerator cabinet, the rear chamber 11 now remains open and free to communicate with the air cooling compartment 4 through the circulated air inlet 4*a* of the latter.

The body 10 further defines, internally, a transversal through-duct 12, which is centrally disposed in front of the rear chamber 11, preferably close to the latter and having an end maintained in fluid communication with the refrigerated air outlet 4*b*. In the exemplified construction, the transversal through-duct 12 has its upper end connected and opened to a central lower region of the plenum 7, and the lower end opened to the inside of the refrigerating compartment 2, more specifically to the inside of a central rear duct 2*b*, which is provided with front air outlet openings 2*c* and affixed to the rear wall of the refrigerating compartment 2.

With the construction described above, the transversal through-duct 12 allows part of the refrigerated airflow that is supplied into the plenum 7 by the fan 6 to be directed to the refrigerating compartment 2 through the central region of the refrigerator cabinet, without requiring a curved path, as it occurs in many prior art solutions. In order to comply with the requirements for the return of air to the evaporator 5, the body 10 further defines at least one first and one second return duct 13, 14, each effecting a fluid communication between one of the freezing compartment 1 and the refrigerating compartment 2 with the rear chamber 11.

In the illustrated embodiment, the system comprises a pair of first return ducts 13, which are disposed along respective opposite lateral regions of the body 10 and have a rear end 13*b* opened to the rear chamber 11, on opposite sides of the transversal through-duct 12, and a front end 13*a* opened to the inside of the freezing compartment 1, as shown in the illustrated embodiment, or even to the refrigerating compartment 2, as it occurs in another non-illustrated embodiment. The body 10 further defines a second return duct 14, which is centrally disposed between the pair of first return ducts 13 and has a front end 14*a* opened to the inside of the other compartment, which in the illustrated embodiment is the refrigerating compartment 2, and a rear end 14*b* bifurcated around the transversal through-duct 12 and opened to the rear chamber 11 between the rear ends 13*b* of the pair of first return ducts 13. In the illustrated example of a combined refrigerator, each first lateral return duct 13 has its front end

13*a* opened to a face of the body 10 facing the freezing compartment 1, in order to define a respective opening for captation of air in the front lower region of the freezing compartment 1.

It should be understood herein that for each of the front ends 13*a* of the first return ducts 13 is provided a respective opening in the intermediate wall 3 for allowing the air to flow, the same occurring in relation to the ends of the transversal through-duct 12.

The first return ducts 13 allow the under-pressure existing in the circulated air inlet 4*a* of the air cooling compartment 4 to cause the formation of an airflow returning from the front lower part of the freezing compartment 1 to the evaporator 5, close to the lateral regions of the latter, which lateral regions can be designed as a function of the temperature and humidity characteristics of this airflow.

Also inside the body 10 is formed a second return duct 14 disposed between the pair of first return ducts 13, in an arrangement substantially coplanar and parallel to the latter and having a front end 14*a*, which is provided in a face of the body 10 turned to the refrigerating compartment 2, and which is opened to the front upper region of the latter, as well as a rear end 14*b* bifurcated around the transversal through-duct 12 and opened to the rear chamber 11 still in the central region of the latter and between the rear ends 13*b* of the first return ducts 13.

The second return duct 14 allows for the captation of the heated air in the front upper region of the refrigerating compartment 2 and the conduction thereof to the central region of the rear chamber 11, wherefrom it is forced to pass through the respective central region of the evaporator 5, which is adequately dimensioned as a function of the temperature and humidity characteristics of the air captured in the refrigerating compartment 2.

The proposed construction allows the transversal through-duct 12 to present a rectilinear development between the front and central region of the plenum 7, below the fan 6, and its inlet in the rear upper region of the refrigerating compartment 2, allowing the existence of an airflow with lower load loss, and consequently a fan 6 of lower capacity.

In the illustrated embodiment, each of the lower half 10*a* and the upper half 10*b* of the body 10 defines a respective half of the cross section of the first return ducts and the second return duct 14, as well as a respective longitudinal extension of the transversal trough-duct 12, the rear chamber 11 being defined, practically in the whole extension thereof, by the lower half 10*a* of the body 10. Only one front upper marginal portion of the rear chamber 11 extending over the rear ends of the first return ducts 13 and of the second return duct 14 is defined by a respective rear marginal portion of the upper half 10*b* of the body 10. As previously mentioned, the function of the first return ducts 13 may be changed with that of the second return duct 14, making it possible to maintain the cold airflow, which is coming down through the transversal through-duct 12, in an adjacent positioning, in the region of the body 10, in relation to the cooler and drier airflow that is returning from the freezing compartment 1 and being conducted through the second return duct 14.

Although the invention has been described and illustrated in relation to a preferred embodiment, it should be understood that modifications could be made as to the form and physical arrangement of the elements, without departing from the constructive concept defined in the enclosed claims of the present specification.

What is claimed is:

1. An air duct system far a combined refrigerator of the forced air circulation type, comprising:

a freezing compartment and a refrigerating compartment, which are superposed and separated by an intermediate wall, further comprising an air cooling compartment lodging an evaporator and a fan and presenting at least one circulated air inlet and at least one refrigerated air outlet directed to the freezing compartment and to the refrigerating compartment, wherein a body is mounted into the interior of the intermediate wall and defines a rear chamber opened to the circulated air inlet;

a transversal through-duct centrally provided in front of the rear chamber and having an end maintained in fluid communication with the refrigerated air outlet, and an opposite end opened to the inside of the refrigerating compartment; and at least one first and one second return duct each presenting a rear end opened to the rear chamber and a front end opened to the interior of the freezing compartment and of the refrigerating compartment, respectively, the rear ends of the first and the second return ducts being positioned on opposite sides of the transversal through-duct.

2. The air duct system according to claim 1, comprising:

a pair of first return ducts disposed along respective opposite lateral regions of the body and having the rear end opened to the rear chamber and the front end opened to the inside of one of the freezing compartment and the refrigerating compartment; and a second return duct centrally disposed between the pair of first return ducts and having the front end opened to the inside of the other of said freezing compartment and refrigerating compartment, and the rear end bifurcated around the transversal through-duct and opened to the rear chamber between the rear ends of the pair of first return ducts.

3. The air duct system according to claim 2, wherein the front ends of the first return ducts are opened to one of the front lower region of the freezing compartment and the front upper region of the refrigerating compartment, the front end of the second return duct being opened to the other of said regions.

4. The air duct system according to claim 2, wherein the front ends of the first return ducts are opened to a face of the body turned to one of the freezing compartment and the refrigerating compartment with which the first return ducts are maintained in fluid communication.

5. The air duct system according to claim 2, wherein the rear chamber presents a width corresponding to the width of the circulated air inlet in the air cooling compartment.

6. The air duct system according to claim 5, wherein the rear chamber presents a width substantially equal to the width of the body.

7. The air duct system according to claim 5, wherein the width of the circulated air inlet is substantially equal to the width of the evaporator.

8. The air duct system according to claim 1, wherein the first return ducts and the second return duct are substantially coplanar and parallel to each other.

9. The air duct system according to claim 1, wherein the refrigerated air outlet of the air cooling compartment is centrally defined, aligned with the fan and opened to the interior of a plenum, which is positioned behind the freezing compartment and separated therefrom by a wall provided with openings for the supply of refrigerated air to the freezing compartment.

10. The air duct system according to claim 9, wherein the transversal through-duct has an end opened to the central lower region of the plenum.

11. The air duct system according to claim 10, wherein the transversal through-duct presents a rectilinear development between the central region of plenum and the refrigerating compartment.

12. The air duct system according to claim 1, wherein the body comprises a lower half and an upper half fitted into each other, and each defining a respective half of the cross section of the first return ducts and of the second return duct, and a respective longitudinal extension of the transversal through-duct.

13. The air duct system according to claim 12, wherein the lower half of the body defines the rear chamber in practically the whole extension thereof.

* * * * *